US009318818B2

(12) United States Patent
Nakamura et al.

(10) Patent No.: US 9,318,818 B2
(45) Date of Patent: Apr. 19, 2016

(54) ELECTRICAL CONNECTOR AND MANUFACTURING METHOD THEREOF

(71) Applicants: Yazaki Corporation, Tokyo (JP); Dowa Metaltech Co., Ltd., Tokyo (JP)

(72) Inventors: Masatoshi Nakamura, Shizuoka (JP); Akifumi Onodera, Tokyo (JP); Akira Sugawara, Tokyo (JP); Hiroto Narieda, Chiyoda-ku (JP); Tatsunori Murata, Tokyo (JP)

(73) Assignees: Yazaki Corporation, Tokyo (JP); Dowa Metaltech Co., Ltd., Tokyo (JP)

( * ) Notice: Subject to any disclaimer, the term of this patent is extended or adjusted under 35 U.S.C. 154(b) by 0 days.

(21) Appl. No.: 14/327,103

(22) Filed: Jul. 9, 2014

(65) Prior Publication Data

US 2014/0322992 A1 Oct. 30, 2014

Related U.S. Application Data

(63) Continuation of application No. PCT/JP2013/050931, filed on Jan. 18, 2013.

(30) Foreign Application Priority Data

Jan. 20, 2012 (JP) ..... 2012-009929
Jan. 18, 2013 (JP) ..... 2013-006912

(51) Int. Cl.
*H01R 13/115* (2006.01)
*H01R 13/20* (2006.01)
(Continued)

(52) U.S. Cl.
CPC ..... *H01R 4/48* (2013.01); *H01R 13/04* (2013.01); *H01R 13/111* (2013.01); *H01R 13/20* (2013.01); *H01R 43/16* (2013.01); *Y10T 29/49204* (2015.01)

(58) Field of Classification Search
CPC ..... H01R 13/115; H01R 13/20
See application file for complete search history.

(56) References Cited

U.S. PATENT DOCUMENTS 3,858,957 A 1/1975 Harwood
7,845,993 B2 * 12/2010 Falchetti ..... H01R 13/113 439/843

(Continued)

FOREIGN PATENT DOCUMENTS

CN 1184344 A 6/1998
CN 1881700 A 12/2006

(Continued)

OTHER PUBLICATIONS

International Search Report issued in Application No. PCT/JP2013/050931, mailed Mar. 19, 2013.

(Continued)

*Primary Examiner* — Gary Paumen
(74) *Attorney, Agent, or Firm* — Michael Best & Friedrich LLP

(57) ABSTRACT

An electrical connector connecting a male connector and a female connector in a freely engageable and detachable manner includes, a male tab is provided at the male connector; a housing part where the male tab is inserted is provided at the female connector; a contact piece and a beat piece to hold and press the male tab to enable electrical connection are provided at the housing part; and a protrusion is provided at least at one of the contact piece and the beat piece, and a recessed part capable of accepting the protrusion is provided at the male tab, wherein the contact piece, the beat piece, and the protrusion are constituted to be one component.

14 Claims, 4 Drawing Sheets

(51) Int. Cl.

| | |
|---|---|
| ***H01R 4/48*** | (2006.01) |
| ***H01R 13/04*** | (2006.01) |
| ***H01R 13/11*** | (2006.01) |
| ***H01R 43/16*** | (2006.01) |

(56) References Cited

U.S. PATENT DOCUMENTS

| | | | | |
|---|---|---|---|---|
| 2002/0022412 | A1* | 2/2002 | Alonson Merino et al. | |
| 2002/0065005 | A1* | 5/2002 | Renkes et al. ..... | 439/849 |
| 2009/0036004 | A1* | 2/2009 | Bowen et al. ..... | 439/849 |

FOREIGN PATENT DOCUMENTS

| | | | |
|---|---|---|---|
| DE | 90 15 110 | U1 | 1/1991 |
| EP | 0 098 650 | A1 | 1/1984 |
| EP | 0 387 683 | A2 | 9/1990 |
| EP | 1 953 872 | A2 | 8/2008 |
| JP | 2000-277197 | A | 10/2000 |
| JP | 2001-266990 | A | 9/2001 |
| JP | 2005-141993 | A | 6/2005 |
| JP | 2006-080004 | A | 3/2006 |
| JP | 2006-134681 | A | 5/2006 |
| JP | 2010-037629 | A | 2/2010 |
| WO | WO-86/02206 | A1 | 4/1986 |
| WO | WO-2011/154116 | A1 | 12/2011 |

OTHER PUBLICATIONS

Extended Search Report issued in European Application No. 13738174.5, dated Sep. 2, 2015.

Office Action issued in Chinese Application No. 201380005679.7, dated Dec. 29, 2015.

* cited by examiner

ELECTRICAL CONNECTOR AND MANUFACTURING METHOD THEREOF

TECHNICAL FIELD

The present invention relates to an electrical connector to easily and surely perform an electrical connection and disconnection. This application is based upon and claims the benefit of priority of the prior Japanese Patent Application No. 2012-9929, filed on Jan. 20, 2012, and Japanese Patent Application No. 2013-6912, filed on Jan. 18, 2013, the entire contents of which are incorporated herein by reference.

BACKGROUND ART

For example, an electrical connector connecting a female connector and a male connector in a freely engageable and detachable manner is used for an electrical connection of a vehicle, an electronic equipment, and so on. When the electrical connector is connected and disconnected, a male tab at the male connector side inserted into the female connector and a contact piece which is electrically connected to the male tab at the female connector side slide with each other, and wear debris are generated.

In general, Sn plating is performed for the male tab at the male connector side and the contact piece at the female connector side, and therefore, Sn wear debris are generated by the slide between the contact piece at the female connector side and the male tab at the male connector side. Electrical resistance of the Sn wear debris becomes high when it is oxidized, and therefore, there is a worry in which contact resistance of the electrical connector becomes high by the wear debris.

In Patent Document 1, a technology in which a projecting part and a hole part are formed at a male terminal and a female terminal which are electrically connected with each other, and the projecting part and the hole part are fitted to thereby prevent the slide is disclosed. Besides, in Patent Document 2, a technology in which a holding part is provided in addition to a contact part to thereby prevent minute slide wear is disclosed. In Patent Document 3, a technology in which a spring piece reinforcing a contact pressure of an elastic contact piece is provided in addition to the elastic contact piece which is in contact with a tab terminal is disclosed. In Patent Document 4, a technology in which plural grooves are provided at a connector contact part to enable a multipoint contact to secure a stable contact is disclosed. In Patent Document 5, a technology in which a slide distance is suppressed to be a distance smaller than a slide trace to thereby secure a gas-tight surface which is not exposed to atmosphere is disclosed. Further, in Patent Document 6, a technology in which a thin Ag—Sn alloy layer is formed on Sn plating to thereby improve minute slide wear resistance is disclosed.

PATENT DOCUMENT

Patent Document 1: Japanese Laid-open Patent Publication No. 2000-277197

Patent Document 2: Japanese Laid-open Patent Publication No. 2006-80004

Patent Document 3: Japanese Laid-open Patent Publication No. 2006-134681

Patent Document 4: Japanese Laid-open Patent Publication No. 2001-266990

Patent Document 5: Japanese Laid-open Patent Publication No. 2005-141993

Patent Document 6: Japanese Laid-open Patent Publication No. 2010-37629

DISCLOSURE OF THE INVENTION

Problems to be Solved by the Invention

Incidentally, in recent years, the number of terminals (the number of pins) of the electrical connector tends to increase, and small-sizing of the terminal is required in accordance with the increase in the number of terminals. However, in a small-sized terminal, sheet thicknesses of materials used for the male tab at the male connector side and the contact piece at the female connector side become thin, and therefore, a contact load becomes small, further, it is impossible to keep an enough displacement amount, and therefore, the contact load between both becomes small. In case of the Sn plating which is widely used to guarantee electrical reliability at a terminal contact point, it is known that the electrical reliability is damaged by minute slide wear caused by minute slide if the contact load is small.

Cost increase is incurred when an expensive noble metal plating such as Au, Ag is used, and the contact load is enlarged by using a high-strength material as measures for a problem as stated above. Besides, a measure to enable a standstill contact point by devising a terminal shape can be cited, but the contact point is easy to move when the contact load is small, and it is difficult to suppress the minute slide wear because the slide wear is generated by the slide in a minute distance. In particular, in the technologies of Patent Documents 1, 3, a contact point between the female terminal and the male terminal to be an electric contact is made to be a combination of recession and projection to suppress the slide distance, and therefore, the contact is easy to be unstable. Besides, in the technologies of Patent Documents 2, 3 the contact point to suppress the slide distance and the electric contact are separately provided, but a complicated spring structure is required to add a high contact load to suppress the slide distance. In particular, in Patent Document 2, there is a description saying "the holding part is an elastic contact, and a frictional resistance is small . . . ", and it is conceivable that an effect to suppress the slide distance is not sufficient.

An object of the present invention is to provide an electrical connector capable of reducing slide wear as much as possible even when a contact load is small, and enabling stable conduction.

Means for Solving the Problems

To solve the above-stated problems, according to the present invention, an electrical connector connecting a female connector and a male connector in a freely engageable and detachable manner, including: a male tab provided at the male connector; a housing part where the male tab is inserted provided at the female connector; a contact piece and a beat piece to hold and press the male tab to enable electrical connection provided at the housing part; a protrusion provided at least at one of the contact piece and the beat piece; and a recessed part capable of accepting the protrusion provided at the male tab, wherein the contact piece, the beat piece, and the protrusion are constituted to be one component, is provided.

Besides, according to the present invention, an electrical connector connecting a female connector and a male connector in a freely engageable and detachable manner, including: a male tab provided at the male connector; a housing part where the male tab is inserted provided at the female connector; a contact piece and a beat piece to hold and press the male tab to enable electrical connection provided at the housing part; a protrusion provided at the male tab; and a recessed part capable of accepting the protrusion provided at least at one of the contact piece and the beat piece, wherein the contact piece, the beat piece, and the recessed part are constituted to be one component, is provided.

In these electrical connectors, a cross sectional shape of the protrusion is, for example, a hemisphere shape, a triangle shape, and a quadrangle shape. Besides, Sn plating may be performed on a surface of the protrusion. Further, plural recessed parts and projecting parts may be provided at a tip surface of the protrusion. Besides, a shape of the protrusion and a shape of the recessed part capable of accepting the protrusion are preferably approximately the same shape.

According to the present invention, a manufacturing method of these electrical connectors, including: forming the protrusion by the press work using a metal mold is provided.

Effect of the Invention

According to the electrical connector of the present invention, in an electrically connected state in which the male tab of the male connector is inserted into the housing part of the female connector, the protrusion is accepted by the recessed part, and thereby, a move of the male tab sandwiched between the contact piece and the beat piece is prevented. Accordingly, it is possible to reduce the slide wear as much as possible. Besides, the slide is prevented by the combination of the protrusion and the recessed part at a part different from a part enabling an electrical contact to separate two functions of an electric contact part and a fixed part. As a result, both the surely suppression of the slide distance by the fixed part, and the stable conduction by the electric contact part are enabled, and electrical reliability improves.

MODE FOR CARRYING OUT THE INVENTION

Figure 1:
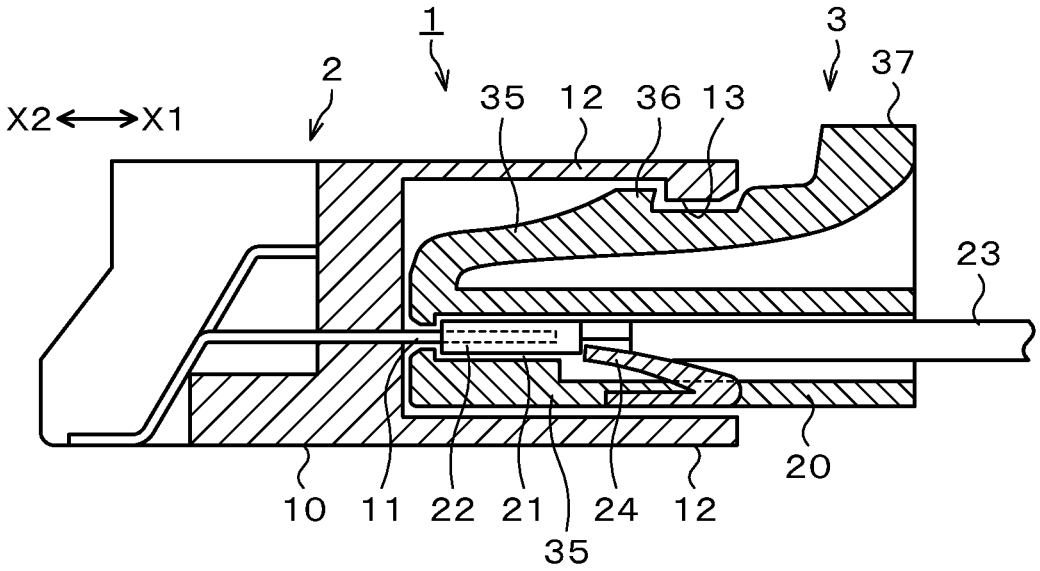
FIG. 1 is a sectional view of an electrical connector according to an embodiment of the present invention.

Hereinafter, an example of an embodiment of the present invention is described with reference to the drawings. Note that in the description and the drawings, the same reference numerals and symbols are used to designate components having substantially the same functional configuration, and the redundant description thereof will not be given. As illustrated in FIG. 1, an electrical connector 1 according to the present embodiment includes a male connector 2 and a female connector 3 which are connectable in a freely engageable and detachable manner with each other.

The male connector 2 illustrated at a left side in FIG. 1 has a constitution in which a male tab 11 made up of a conductive material as a male terminal protrudes at a tip surface of a male side resin molding part 10. A cylindrical male side cover 12 disposed to surround a periphery of the male tab 11 is provided at the male side resin molding part 10. A male side engaging lock 13 is provided toward inside at an inner peripheral surface of the male side cover 12.

On the other hand, at the female connector 3 illustrated at a right side in FIG. 1, a box type housing part (cavity) 21 where the male tab 11 is inserted is provided inside a female side resin molding part 20. A female terminal 22 made up of a conductive material is inserted into the housing part 21 from a rear surface side (a right surface side in FIG. 1) of the female side resin molding part (cavity) 20. An electric wire 23 is electrically connected to a rear end (right end in FIG. 1) of the female terminal 22. The female terminal 22 inserted into the housing part 21 is pressed by an elastic lance 24 so as not to fall off.

Figure 2:
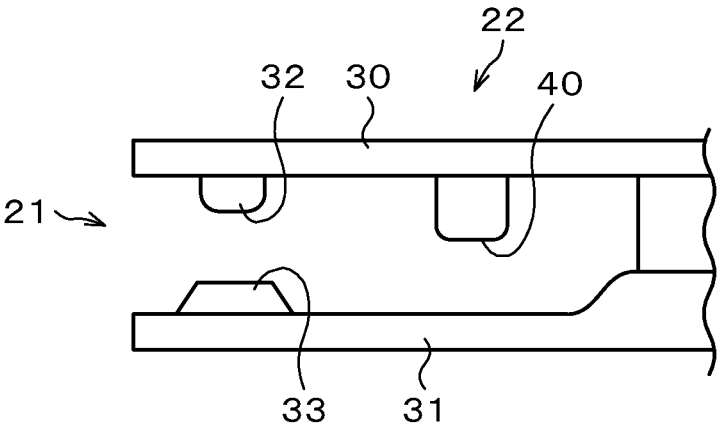
FIG. 2 is an enlarged view of a housing part.

As illustrated in FIG. 2, a contact piece 30 and a beat piece 31 are held inside the female terminal 22. A contact point 32 is provided at an inner surface (a surface facing the male tab 11 inserted into the female terminal 22, and a lower surface of the contact piece 30 in FIG. 2) of the contact piece 30. Besides, a beat protrusion 33 is provided at an inner surface (a surface facing the male tab 11 inserted into the female terminal 22, and an upper surface of the beat piece 31 in FIG. 2) of the beat piece 31. These contact point 32 and beat protrusion 33 are disposed to face with each other with a predetermined distance. As illustrated in FIG. 1 the male tab 11 is inserted into the female terminal 22, and thereby, the contact point 32 and the beat protrusion 33 are brought into contact with upper and lower surfaces of the male tab 11, and the male tab 11 is sandwiched between the contact piece 30 and the beat piece 31 in the female terminal 22. As a result, the male terminal (male tab 11) of the male connector 2 and the female terminal 22 of the female connector 3 become an electrically connected state.

Note that in FIG. 1, a direction moving the male connector 2 in a right direction relative to the female connector 3 is an insertion direction X1 of the male tab 11. Besides, a direction moving the male connector 2 in a left direction relative to the female connector 3 is an extraction direction X2 of the male tab 11.

The housing part 21 is covered with a cylindrical female side cover 35. A female side engaging lock 36 which is supported to be freely elastically deformed relative to the female side resin molding part 20 is provided toward outside at an outer peripheral surface of the female side cover 35. As illustrated in FIG. 1, the male connector 2 is moved in the insertion direction X1, the female cover 35 of the female connector 3 is inserted into the male side cover 12 of the male connector 2 to engage the male side engaging lock 13 and the female side engaging lock 36, and thereby, a connection state of the electrical connector 1 is held. Besides, under the connection state of the electrical connector 1, the male tab 11 is inserted into the female terminal 22, enters between the contact piece 30 and the beat piece 31, the contact point 32 and the beat protrusion 33 are brought into contact with the upper and lower surfaces of the male tab 11, and thereby, the male terminal (male tab 11) of the male connector 2 and the female terminal 22 of the female connector 3 become the electrically connected state.

Note that a release protrusion 37 formed at an outer peripheral surface of the female side resin molding part (cavity) 20 is pressed, and thereby, the female side engaging lock 36 is pushed, and it becomes a state in which engagement between the male side engaging lock 13 and the female side engaging lock 36 is disengaged. It is thereby possible to pull out the male connector 2 from the female connector 3, and the electrical connection between the male terminal (male tab 11) of the male connector 2 and the female terminal 22 of the female connector 3 is released.

Figure 3:
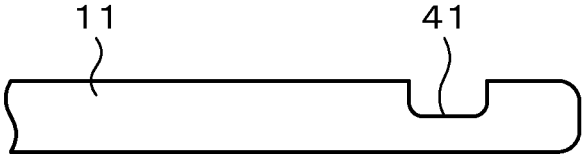
FIG. 3 is an enlarged view of a male tab.

Further, a protrusion 40 protruding toward an upper surface of the male tab 11 inserted into the housing part 21 is provided at the inner surface (the surface facing the male tab 11 inserted into the housing part 21, and the lower surface of the contact piece 30 in FIG. 2) of the contact piece 30. Besides, as illustrated in FIG. 3, a recessed part 41 capable of accepting the protrusion 40 is provided at the upper surface of the male tab 11. As illustrated in FIG. 1, the protrusion 40 provided at the contact piece 30 becomes a state accepted by the recessed part 41 provided at the male tab 11 under the connection state of the electrical connector 1, and thereby, a move of the male tab 11 sandwiched between the contact piece 30 and the beat piece 31 is prevented.

As illustrated in FIG. 2, the protrusion 40 is disposed at a further distant side than the contact point 32 and the beat protrusion 33 in the housing part 21. A length (height) of the protrusion 40 is set to be longer than the contact point 32. Note that the female terminal 22 where the contact point 32 and the protrusion 40 are formed at the contact piece 30 and the beat protrusion 33 is formed at the beat piece 31 as stated above is integrally molded by performing the press work using a metal mold of, for example, a metal thin sheet and so on. The female terminal 22 is thereby constituted to be one component in which the contact point 32 and the protrusion 40 are included at the contact piece 30, and the beat protrusion 33 is included at the beat piece 31.

Figure 4:
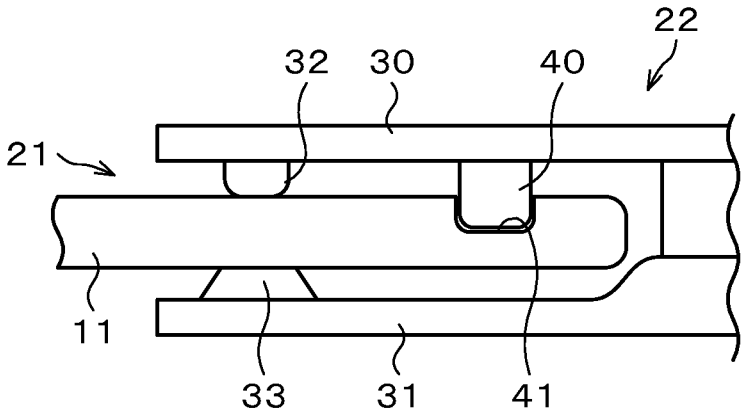
FIG. 4 is an enlarged view of a state in which the male tab is inserted into the housing part.

On the other hand, as illustrated in FIG. 3, the recessed part 41 is disposed at a position near a tip of the male tab 11. Accordingly, as illustrated in FIG. 4, under the connection state of the electrical connector 1, the protrusion 40 is accepted by the recessed part 41 at the distant side in the housing part 21, the move of the male tab 11 sandwiched between the contact piece 30 and the beat piece 31 is prevented, the contact point 32 and the beat protrusion 33 are in contact with the upper and lower surfaces of the male tab 11 at an entrance side in the housing part 21, and thereby, the male tab 11 and the female terminal 22 are electrically connected.

Besides, it is preferable that a shape of the protrusion 40 and a shape of the recessed part 41 are approximately the same shape. Namely, for example, as illustrated in FIG. 2 and FIG. 3, when the protrusion 40 has approximately a cylindrical shape, and the recessed part 41 has approximately a cylindrical shape whose diameter is a little larger than the approximately cylindrical shape of the protrusion 40, a bottom part of the approximately cylindrical shape of the recessed part 41 and a top part of the approximately cylindrical shape of the protrusion 40 are brought into contact when the recessed part 41 accepts (fits to) the protrusion 40, and at least a part of a side part (including an end part) of the approximately cylindrical shape of the recessed part 41 and a side part of the approximately cylindrical shape of the protrusion 40 are brought into contact.

The shape of the protrusion 40 and the shape of the recessed part 41 are approximately the same shape, and thereby, the top part of the protrusion 40, the bottom part of the recessed part 41, and the side parts with each other are in close contact states when the protrusion 40 is accepted by the recessed part 41, and they are fixed by the fit and the frictional force. As a result, it is possible not only to prevent the move (slide) in the X1 direction and X2 direction but also to suppress the slide in a direction perpendicular to the X1 direction and the X2 direction, and in the other directions.

Besides, it is possible to prevent minute slide which is easy to occur when a contact load at the contact point is a minute load such as, for example, 3 N or less by enabling the above-stated state, and therefore, it is possible to suppress the minute slide wear in particular.

In recent years, owing to requirements particularly for small-sizing in a terminal, and for making plate-state terminal materials of the female terminal and the male terminal thinner, sheet-thicknesses of the contact piece, the beat piece, and the male tab become thin such as 0.20 mm or less, further 0.15 mm or less. However, the protrusion 40 and the recessed part 41 of the present invention are formed, and thereby, it is possible to enough suppress the slide even though the sheet-thicknesses become thinner, and to obtain effects of the present invention.

In the electrical connector 1 constituted as stated above, the move of the male tab 11 sandwiched between the contact piece 30 and the beat piece 31 is prevented under the state in which the male connector 2 and the female connector 3 are electrically connected, and the slide wear can be reduced as much as possible. Accordingly, it is possible to avoid problems such as an increase of contact resistance and heat generation caused by generation of wear debris, and to enable a good electrical connection. Besides, a part where the electrical contact is enabled by sandwiching the male tab 11 between the contact point 32 and the beat protrusion 33 and a part where the slide is prevented by the protrusion 40 accepted by the recessed part 41 are separately provided. Accordingly, two functions of the electric contact part and the fixed part are separated, and both the surely suppression of the slide distance by the fixed part and the stable conduction by the electric contact part are enabled, and the electric reliability improves.

Figure 5:
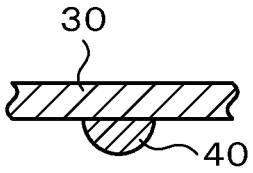
FIG. 5 is a sectional view of a protrusion whose cross sectional shape is a hemisphere shape.
Figure 6:
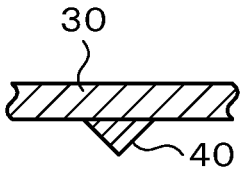
FIG. 6 is a sectional view of the protrusion whose cross sectional shape is a triangle shape.
Figure 7:
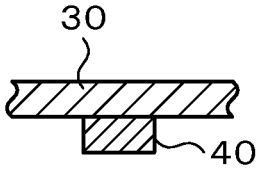
FIG. 7 is a sectional view of the protrusion whose cross sectional shape is a quadrangle shape.

Hereinabove, the embodiments of the present invention are exemplified to be described, but the present invention is not limited to the embodiments described here. For example, the cross sectional shape of the protrusion 40 may be a hemisphere shape as illustrated in FIG. 5, a triangle shape (for example, a triangular pyramid or a quadrangular pyramid) as illustrated in FIG. 6, and a quadrangle shape (for example, a rectangular parallelepiped or a regular hexahedron) as illustrated in FIG. 7 and so on. Besides, it is not limited to these shapes but may be an arbitrary shape. Besides, the shape of the recessed part 41 may be anyone as long as the protrusion 40 is acceptable, and is able to be an arbitrary shape.

Besides, as stated above, if the shape of the protrusion 40 and the shape of the recessed part 41 are approximately the same shape, it is possible to further suppress the slide distance.

Figure 8:
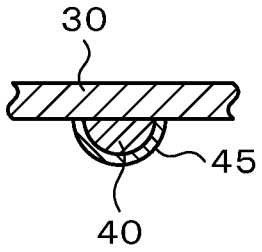
FIG. 8 is a sectional view of the protrusion in which Sn plating is performed on a surface.

Besides, as illustrated in FIG. 8, Sn plating 45 may be performed on a surface of the protrusion 40. It is preferable to use conductive base materials made up of a copper alloy for the male terminal (male tab) and the female terminal (contact piece, beat piece), and a Cu—Ni—Sn based alloy (for example, the copper alloy such as NB-109 and NB-105 manufactured by DOWA METALTECH Co., Ltd.), the conductive base materials made up of phosphor bronze, brass and so on can be used. In particular, as the conductive base material for the female terminal, the conductive base material made up of a high-strength copper alloy such as Be copper, titanium copper may be used, but these copper alloys are high cost, and therefore, it is preferable to use a Cu—Ni—Si based (Corson) alloy, the Cu—Ni—Sn based alloy, the conductive base material made up of the phosphor bronze and so on which are lower cost, and as the conductive base material for the male terminal, it is preferable to use the conductive base material made up of the brass. Besides, as the conductive base material for the male terminal or the female terminal, an iron based material such as stainless (SUS), the conductive base material made up of an aluminum alloy and so on may be used.

Each of the female terminal 22 and the male tab 11 made up of metal materials as stated above can be constituted to be one component by performing the press work using a metal mold to be integrally molded. Note that one component means that each of the female terminal 22 and the male tab 11 is made up of one continuous material. The shapes of the female terminal 22 and the male tab 11 are simplified, and thereby, it becomes possible to reduce a manufacturing cost and shorten manufacturing processes. Note that the female terminal 22 and the male tab 11 may be manufactured by the other methods without being limited to the press work.

Besides, the Sn plating or the like may be performed on uppermost surfaces of the female terminal 22 and the male tab 11. If the Sn plating is used, it is not necessary to perform the expensive noble metal plating such as Au, Ag, so it is preferable in cost phase. As a film structure, only the Sn plating, an Ni base plating-a Cu plating-the Sn plating, the Ni base plating-the Cu plating-a CuSn compound-the Sn plating, the CuSn compound-the Sn plating, the Ni base plating-the Sn plating and so on from a surface side of the conductive base material for the female terminal 22, the male tab 11, and so on are exemplified. Besides, the reflow treatment, the gloss treatment, and so on may be performed according to need. The CuSn compound is able to be formed by performing the heat treatment such as the reflow for the Sn plating. Besides, the Cu—Ni—Sn based alloy is selected as the conductive base material, and the Sn plating and so on is formed, it is preferable because recycling of the materials becomes easy. The press work to manufacture the female terminal 22 and the male tab 11 may be performed before or after the plating process. The Sn plating 45 illustrated in FIG. 8 is made thick, and thereby, it is possible to enlarge a friction coefficient at the surface of the protrusion 40. A thickness of the Sn plating 45 is to be set at 2 μm or more. The friction coefficient of the Sn plating 45 is made large, and thereby, the effect to make the slide distance small can be obtained.

Besides, as stated above, if the shape of the protrusion 40 and the shape of the recessed part 41 are approximately the same shape, it is possible to further suppress the slide distance.

Note that as illustrated in FIG. 4, the protrusion 40 is disposed at the distant side in the housing part 21, then the male tab 11 is brought into contact with the uppermost surface of the protrusion 40 only at a last of the connection time of the electrical connector 1. Accordingly, wear of the Sn plating 45 performed on the protrusion 40 can be suppressed to minimum, and the suppression effect of the slide distance by the Sn plating 45 can be obtained for a long period of time.

Figure 9:
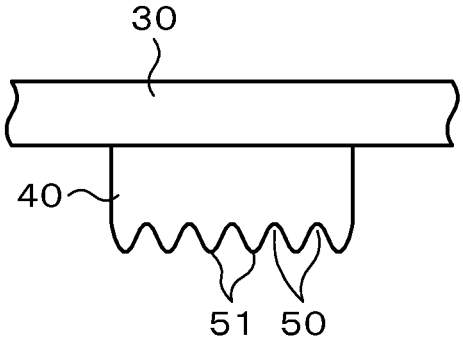
FIG. 9 is an explanatory view of the protrusion where plural recessed parts and projecting parts are provided at a tip surface.
Figure 10:
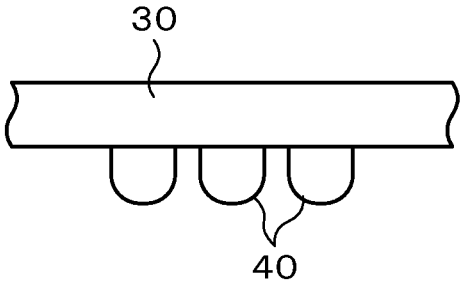
FIG. 10 is an explanatory view of plural hemisphere protrusions.
Figure 11:
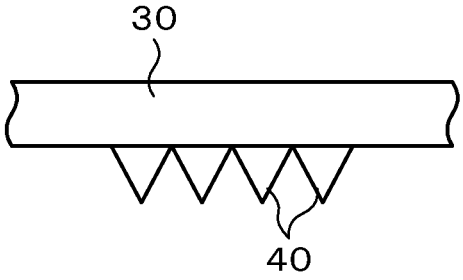
FIG. 11 is an explanatory view of plural triangle protrusions.

Besides, as illustrated in FIG. 9, plural recessed parts 50 and projecting parts 51 may be provided at a tip surface (a lower surface in the illustrated example) of the protrusion 40. As stated above, the plural recessed parts 50 and projecting parts 51 are provided at the tip surface of the protrusion 40, and thereby, the contact with the recessed part 41 becomes a multipoint contact, and it is possible to further suppress the slide distance because the friction coefficient becomes larger. In this case, the recessed parts 50 and the projecting parts 51 are able to form by the laser processing, the discharge etching process, and so on. Besides, the recessed parts 50 and the projecting parts 51 may be formed by the plating process. Note that hemispherical protrusions 40 may be provided in plural as illustrated in FIG. 10, triangle (for example, the triangular pyramid or the quadrangular pyramid) protrusions 40 may be provided in plural as illustrated in FIG. 11 to obtain the similar effects.

Besides, as stated above, if the shape of the protrusion 40 and the shape of the recessed part 41 are approximately the same shape, it is possible to further suppress the slide distance.

Figure 12:
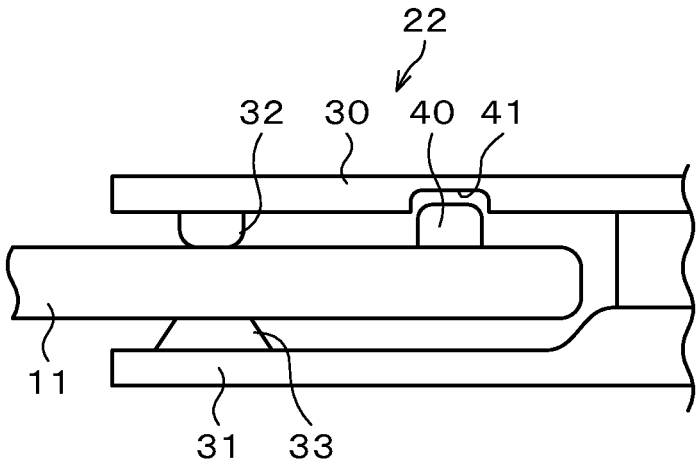
FIG. 12 is an enlarged view of a housing part according to an embodiment in which a recessed part is provided at a contact piece, and a protrusion is provided at a male tab.

In the embodiment illustrated in FIG. 1 to FIG. 4, the mode in which the protrusion 40 is provided at the contact piece 30, and the recessed part 41 is provided at the male tab 11 is illustrated, but the recessed part 41 may be provided at the contact piece 30 and the protrusion 40 may be provided at the male tab 11 as illustrated in FIG. 12. Similarly, according to the mode illustrated in FIG. 12, the protrusion 40 is accepted by the recessed part 41 under the connection state of the electrical connector 1, and the move of the male tab 11 sandwiched between the contact piece 30 and the beat piece 31 is prevented. It is thereby possible to enable both the surely suppression of the slide distance and the stable conduction, and the electrical reliability improves.

Besides, the protrusion 40 and the recessed part 41 may be provided at the beat piece 31 without being limited to the contact piece 30. For example, the protrusion 40 may be provided at the beat piece 31, and the recessed part 41 may be provided at the male tab 11. Besides, the recessed part 41 may be provided at the beat piece 31, and the protrusion 40 may be provided at the male tab 11. Similarly, according to the mode, the protrusion 40 is accepted by the recessed part 41 under the connection state of the electrical connector 1, and the move of the male tab 11 sandwiched between the contact piece 30 and the beat piece 31 is prevented. It is thereby possible to enable both the surely suppression of the slide distance and the stable conduction, and the electrical reliability improves.

EXPLANATION OF CODES

X1 insertion direction
X2 extraction direction
1 electrical connector
2 male connector
3 female connector
10 male side resin molding part
11 male tab
12 male side cover
13 male side engaging lock
20 female side resin molding part
21 housing part
22 female terminal
23 electric wire
24 lance
30 contact piece
31 beat piece
32 contact point
33 beat protrusion
35 female side cover
36 female side engaging lock
37 release protrusion

40 protrusion
41 recessed part

What is claimed is:

1. An electrical connector including a female connector and a male connector in a freely engageable and detachable manner, comprising:

a male tab provided at the male connector;

a housing part where the male tab is inserted provided at the female connector;

an electrical contact part made up of a contact point provided at a contact piece and a beat protrusion provided at a beat piece to hold and press the male tab to enable electrical connection provided at the housing part;

a protrusion provided at least at one of the contact piece and the beat piece at a position different from the electrical contact part, and a recessed part accepting the protrusion provided at the male tab, wherein the contact piece, the beat piece, and the protrusion are constituted to be one component, and a height of the protrusion is higher than a height of the contact point.

2. An electrical connector including a female connector and a male connector in a freely engageable and detachable manner, comprising:

a male tab provided at the male connector;

a housing part where the male tab is inserted provided at the female connector;

an electrical contact part made up of a contact point provided at a contact piece and a beat protrusion provided at a beat piece to hold and press the male tab to enable electrical connection provided at the housing part;

a protrusion provided at the male tab, and a recessed part accepting the protrusion provided at least at one of the contact piece and the beat piece at a position different from the electrical contact part, wherein the contact piece, the beat piece, and the recessed part are constituted to be one component, and a height of the protrusion is higher than a height of the contact point.

3. The electrical connector according to claim 1, wherein a cross sectional shape of the protrusion is any one of a hemisphere shape, a triangle shape, and a quadrangle shape.

4. The electrical connector according to claim 1, wherein Sn plating is performed on a surface of the protrusion.

5. The electrical connector according to claim 1, wherein plural recessed parts and projecting parts are provided at a tip surface of the protrusion.

6. The electrical connector according to claim 1, wherein a shape of the protrusion and a shape of the recessed part accepting the protrusion are approximately the same shape.

7. A manufacturing method of an electrical connector according to claim 1, comprising:

forming the protrusion by the press work using a metal mold.

8. The electrical connector according to claim 2, wherein a cross sectional shape of the protrusion is any one of a hemisphere shape, a triangle shape, and a quadrangle shape.

9. The electrical connector according to claim 2, wherein Sn plating is performed on a surface of the protrusion.

10. The electrical connector according to claim 2, wherein plural recessed parts and projecting parts are provided at a tip surface of the protrusion.

11. The electrical connector according to claim 2, wherein a shape of the protrusion and a shape of the recessed part accepting the protrusion are approximately the same shape.

12. A manufacturing method of an electrical connector according to claim 2, comprising:

forming the protrusion by the press work using a metal mold.

13. The electrical connector according to claim 1, wherein the protrusion is provided at a further distant side than the electrical contact part in the housing part.

14. The electrical connector according to claim 2, wherein the recessed part is provided at a further distant side than the electrical contact part in the housing part.

* * * * *